United States Patent [19]

Bender

[11] Patent Number: 4,981,536

[45] Date of Patent: Jan. 1, 1991

[54] STABILIZED PROPELLANT COMPOSITION FOR THE GENERATION OF NONTOXIC PROPELLANT GASES

[75] Inventor: Richard Bender, Lauf, Fed. Rep. of Germany

[73] Assignee: Dynamit Nobel Aktiengesellschaft, Troisdorf, Fed. Rep. of Germany

[21] Appl. No.: 453,944

[22] Filed: Dec. 19, 1989

[30] Foreign Application Priority Data

Dec. 20, 1988 [DE] Fed. Rep. of Germany ..... 3842838

[51] Int. Cl.[5] ..... C06B 35/00

[52] U.S. Cl. ..... 149/35; 149/61

[58] Field of Search ..... 149/35, 61

[56] References Cited

U.S. PATENT DOCUMENTS 3,920,575 11/1975 Shiki et al. ..... 149/35

3,936,330 2/1976 Dergazarian et al. ..... 149/35

4,021,275 5/1977 Kishi et al. ..... 149/35

4,734,141 3/1988 Cartwright et al. ..... 149/35

*Primary Examiner*—Stephen J. Lechert, Jr.

*Attorney, Agent, or Firm*—Antonelli, Terry, Stout & Kraus

[57] ABSTRACT

The present invention concerns propellant compositions for the generation of nontoxic gases which are utilized, for example, in airbag generators. These compositions contain, as a gas-yielding component, at least one alkali azide. According to the invention, the compositions are stabilized against the effects of moisture and carbon dioxide by the addition of talc and/or magnesium oxide. These additives are included in amounts of from 3 to 10% by weight. The additive acts so that the propellant compositions do not release hydrazoic acid even under the action of moisture and/or carbon dioxide.

16 Claims, No Drawings

STABILIZED PROPELLANT COMPOSITION FOR THE GENERATION OF NONTOXIC PROPELLANT GASES

The present invention relates to a propellant composition for the production of nontoxic gases, this composition being stabilized by the addition of specific compounds against the attack of atmospheric humidity and carbon dioxide. Such propellant compositions are utilized preferably in airbag generators which have to have a service life of 15 years.

Propellant compositions for the generation of nontoxic propellant gases are known per se. Such compositions contain, as gas-yielding components, the nonexplosive salts of hydrazoic acid, primarily alkali azides, and, as the oxidizing agent, alkali nitrates or perchlorates. Also CuO has been suggested as an oxidizing agent. For an improved slag formation, the compositions are optionally combined with fine-grained silicon dioxide and/or boron oxide, or other melt-forming compounds (compare DE No. 2,236,175-C3).

However, these azide-containing propellant charge mixtures exhibit the drawback that the compositions partially decompose, with the formation of free hydrazoic acid, when stored in carbon dioxide-containing moist air. Since this acid is a highly toxic gas (maximum allowable concentration, MAC=1 ppm) and furthermore explosively decomposes at an elevated temperature, formation of this free acid is to be avoided at all cost. For this reason, it has been proposed to envelop the entire propellant charge in a moistureproof fashion with, for example, self-adhesive aluminum foils or soldered metal capsules. However, these sealing means do not ensure complete exclusion of moisture for an airbag generator manufactured with the use of a thus-protected propellant charge over the entire service life of the generator.

Therefore, there was the problem of finding propellant compositions for the generation of nontoxic propellant gases wherein hydrazoic acid is not released even upon exposure to humid and carbon-dioxide-containing air.

In solving this problem, propellant compositions have now been discovered based on alkali azides and inorganic oxidizing agents, characterized in that the compositions contain as stabilizer magnesium oxide and/or talc in amounts of from 3 to 10% by weight, based on the total weight of the composition.

With the use of the additives according to this invention, the azide-containing propellant charges can also be stored in a moist and carbon dioxide-containing atmosphere without hydrazoic acid being liberated. The additive of this invention has an especially advantageous effect in case of azide-containing propellant charges which additionally include melt-forming compounds, such as pyrogenic silicic acid or boron oxide, since the presence of these compounds in such propellant charges promote the release of hydrazoic acid. Azide-containing propellant charges with these melt-forming additives are likewise stabilized by means of this invention.

The additives according to the invention furthermore act as press-molding aids in the preparation of tablets form the propellant compositions of this invention. Such tablets exhibit improved cohesion and accordingly can be placed under greater mechanical stresses than tablets devoid of the additive.

This improved mechanical strength is achieved, in particular, by the addition of talc with a mesh-like structure.

Talc is to include, according to this invention, the naturally occurring mineral of the ideal formula 3 $MgO \cdot 4\ SiO_2 \cdot H_2O$ wherein portions of the magnesium oxide can be replaced by calcium oxide. The calcium oxide content of the talc can range between 0 and up to and including 6% by weight, based on the weight of the talc. The magnesium oxide in the talc can also be partially replaced by $Al_2O_3$ or iron oxide. The proportion of these oxides in the talc can be up to 4% by weight for $Al_2O_3$ and up to 2% by weight for $Fe_2O_3$. Accordingly, the MgO content of the talc utilized according to this invention ranges between 26 and 31.6%. The talc must be free of asbestos when using the propellant charges of this invention in gas generators for automotive vehicle airbags.

The content of talc and MgO in the propellant compositions according to the invention ranges from 3 to 10% by weight, preferably from 5 to 8% by weight. In principle, it is possible to utilize only one of the two compounds to attain the desired effect. However, preferably a mixture of the two materials is employed wherein the weight ratio of MgO:talc is preferably between 1:1.3 and 1:10, especially preferably between 1:2 and 1:3.

The propellant compositions of this invention contain preferably additionally a melt-promoting compound as described, for example, in DE No. 2,236,175-C3. Finely dispersed silicic acid or boron oxide is used with preference for this purpose. The finely dispersed silicic acid has a specific surface area of 100–500 $m^2/g$, preferably 200–400 $m^2/g$, and is preferably utilized in amounts of from 16 to 20% by weight, based on the total weight of the combustion.

The proportion of alkali azides, e.g. sodium azide, potassium azide, etc., in the compositions of this invention generally ranges between 50 and 60% by weight, preferably between 54 and 57% by weight. The preferred oxidizing agent is potassium nitrate which can also be partially replaced by sodium nitrate. However, other inorganic oxidizing agents are usable, in principle. The amount of the oxidizing agents is generally on the order of from 10 to 30% by weight.

EXAMPLE

A mixture was produced from 57 parts by weight of sodium azide
18 parts by weight of potassium nitrate
18 parts by weight of pyrogenic silicic acid (specific surface area 200 $m^2/g$)
5 parts by weight of talc
2 parts by weight of MgO.

The talc contained a proportion of CaO of 4.0% by weight and of $Al_2O_3$ of 3.0% by weight. Consequently, the MgO content was 28.0% by weight.

The mixture was pressed into tablets having a diameter of 20–30 mm under a molding pressure of about 1 $t/cm^2$. No free hydrazoic acid was formed during storage of the tablets without a sealing envelope in air having a relative atmospheric humidity of 60% and a $CO_2$ content of 1% for periods of 48 to 96 hours, respectively.

What is claimed is:

1. A propellant composition for generating nontoxic propellant gases wherein hydrazoic acid is not released, which comprises an alkali azide, an inorganic oxidizing agent, and as the stabilizer for preventing release of hydrazoic acid upon exposure of the composition to humid and carbon dioxide-containing atmosphere, magnesium oxide and/or talc in amounts of between 3 and 10% by weight, based on the weight of the total composition; said talc having a MgO content of between 26% and 31.6% by weight.

2. A propellant composition according to claim 1, wherein said composition contains a mixture of the magnesium oxide and talc in which the ratio of talc:magnesium oxide ranges from 10:1 to 1.3:1.

3. A propellant composition according to claim 1, wherein said composition contains, besides an alkali azide and an inorganic oxidizing agent, additional finely dispersed silicon dioxide or another compound leading to the formation of vitreous melts.

4. A propellant composition according to claim 2, wherein said composition contains, besides an alkali azide and an inorganic oxidizing agent, additional finely dispersed silicon dioxide or another compound leading to the formation of vitreous melts.

5. A propellant composition according to claim 4, wherein the composition contains 50 to 60% by weight of an alkali azide, 10 to 30% by weight of an oxidizing agent and up to 20% by weight of the compound leading to the formation of vitreous melts.

6. A propellant composition according to claim 5, wherein the alkali azide is sodium azide; the oxidizing agent is potassium nitrate; and the compound leading to the formation of vitreous melts is pyrogenic silicic acid.

7. A propellant composition according to claim 1, wherein the talc is a mineral represented by the formula: $3MgO{\cdot}4SiO_2{\cdot}H_2O$ wherein portions of the MgO can be replaced with calcium oxide, $Al_2O_3$ and $Fe_2O_3$; the proportions of $Al_2O_3$ can be up to 4% by weight, the proportions of calcium oxide can be up to 6% by weight, and the proportions of $Fe_2O_3$ can be up to 2% by weight.

8. A propellant composition according to claim 3, wherein the composition contains 50 to 60% by weight of an alkali azide, 10 to 30% by weight of an oxidizing agent and up to 20% by weight of the compound leading to the formation of vitreous melts.

9. A propellant composition according to claim 8, wherein the alkaline azide is sodium azide; the oxidizing agent is potassium nitrate; and the compound leading to the formation of vitreous melts is pyrogenic silicic acid.

10. A propellant composition according to claim 1, wherein the composition contains as a stabilizer, magnesium oxide and/or talc in amounts of from 5 to 8% by weight.

11. A propellant composition according to claim 1, wherein the stabilizer consists of a mixture of magnesium oxide and talc.

12. A propellant according to claim 11, wherein the talc is a mineral represented by the formula: $3MgO{\cdot}4SiO_2{\cdot}H_2O$, wherein portions of the MgO can be replaced with calcium oxide, $Al_2O_3$ and $Fe_2O_3$; the proportions of $Al_2O_3$ can be up to 4% by weight, the proportions of calcium oxide can be up to 6% by weight, and the proportions of $Fe_2O_3$ can be up to 2% by weight.

13. A propellant composition according to claim 12, wherein said composition contains the mixture of magnesium oxide and talc in a ratio of talc:magnesium oxide ranging from 10:1 to 1.3:1.

14. A propellant composition according to claim 1, wherein the stabilizer consists of magnesium oxide.

15. A propellant composition according to claim 1, wherein the stabilizer consists of talc.

16. A propellant composition according to claim 14, wherein the talc is a mineral represented by the formula: $3MgO{\cdot}4SiO_2{\cdot}H_2O$ wherein portions of the MgO can be replaced with calcium oxide, $Al_2O_3$ and $Fe_2O_3$; the proportions of $Al_2O_3$ can be up to 4% by weight, the proportions of calcium oxide can be up to 6% by weight, and the proportions of $Fe_2O_3$ can be up to 2% by weight.

* * * * *